United States Patent [19]

Bartram et al.

[11] 3,949,487

[45] Apr. 13, 1976

[54] HAIR DRYER

[75] Inventors: Nial C. Bartram, Wilmington, Del.; William J. Scheid, Leola, Pa.

[73] Assignee: Schick Incorporated, Lancaster, Pa.

[22] Filed: Sept. 5, 1973

[21] Appl. No.: 394,462

Related U.S. Application Data

[63] Continuation of Ser. No. 253,634, May 15, 1972, abandoned.

[52] U.S. Cl. ..... 34/99; 174/66

[51] Int. Cl.[2] ..... A45D 20/24

[58] Field of Search ..... 34/90, 91, 96–101; 174/135, 46, 66; 128/66; 15/DIG. 10, 343

[56] References Cited

UNITED STATES PATENTS

| | | | |
|---|---|---|---|
| 1,365,762 | 1/1921 | Zinow | 15/DIG. 10 |
| 2,438,143 | 3/1948 | Brown | 174/66 |
| 3,267,587 | 8/1966 | Niemiec et al. | 34/99 |
| 3,383,700 | 5/1968 | Taylor | 34/99 |
| 3,503,138 | 3/1970 | Fuchs et al. | 34/99 |
| 3,513,563 | 5/1970 | Ziegler | 34/99 |
| 3,731,396 | 5/1973 | McLean | 34/99 |

FOREIGN PATENTS OR APPLICATIONS

| | | | |
|---|---|---|---|
| 487,515 | 6/1938 | United Kingdom | 15/DIG. 10 |

*Primary Examiner*—John J. Camby
*Assistant Examiner*—Henry C. Yuen
*Attorney, Agent, or Firm*—Lockwood, Dewey, Zickert & Alex

[57] ABSTRACT

A portable hair dryer of the hard hat type having the general configuration of an articulated, collapsible "Z." The head assembly and a base are pivotally mounted at the ends of a head mounting assembly on parallel, horizontal axes so that the base and the head assembly can be pivoted to nest the base and head mounting assembly within the head assembly. Electrical cord retaining means are provided on that portion of the head mounting assembly, the middle element in the hinged "Z," which is exposed to the head space within the head assembly when the dryer is in the collapsed or nested storage condition, and the cord is introduced to the dryer through that same portion. The cord can therefore be stored out of the way within the head assembly, without interfering with pivot hinges, or with moving surfaces which are closely spaced apart during nesting.

4 Claims, 4 Drawing Figures

HAIR DRYER

This is a continuation of application Ser. No. 253,634, filed May 15, 1972, now abandoned.

This invention relates to a hair dryer providing particularly convenient and safe storage for its electrical cord.

The problem of electrical appliance cord storage has been particularly annoying in regard to those appliances which are used periodically and put into temporary storage out of the way, between uses. Hair dryers are examples of such appliances in which the units are used from time to time, and customarily put out of the way in temporary storage between uses. Inadequate provision for the safe and convenient storage of the dryer's electrical cord has been a common complaint with respect to hair dryers heretofore available.

To make no provision for electrical cord storage, and to require that the cord be left loose and exposed, for example, is most unsatisfactory. For example, a loose, exposed cord becomes a nuisance when it interferes with other items in a storage compartment. The loose cord can be dragged off the shelf inadvertently with other items sometimes causing accidental pulling of the dryer or other items from the compartment. In addition loose electrical cords present an unsightly storage area. Moreover, a pile of several loose cords tends to become entangled, thus subjecting the user to another nuisance, and delay for the purpose of freeing the desired cord.

Various small appliance cord storage proposals have been made, for example, it has been suggested that separate cords be provided, that biased self-winding reel units be mounted within appliances, or that provision be made to wrap the cords around the outside of appliances. For example, one hair dryer heretofore available requires that the electrical cord be wrapped around the appliance when the appliance is placed in a storage case. Quite often such cords are loose enough, or twisted or looped, and interfere with the closing of the storage case, thus risking damage to case hinges to the cord, as well.

A major disadvantage of the separate cord approach is the substantial risk that the disconnected cord can become separated from the appliance and considerable delay may be encountered in locating the misplaced cord. Additionally, the separate cord requires a double plug-in, and at least some provision somewhere for the storage of the disconnected separate cord.

While the self-winding biased reel approach is quite convenient, the bulkiness which is inherently associated with the biasing mechanism, and the storage reel, necessarily increases the bulkiness of the appliance. It is highly desirable that the cord storage feature not substantially increase the bulkiness of the appliance, or the amount of storage space required for the unit.

The wraparound cord storage is generally unsatisfactory. While the appliance is being carried, perhaps to or from storage, the wraparound cord loops have a tendency to become dislodged and fall off when these appliances are handled. Appliances with exposed wraparound cords can be considered to be unsightly. Moreover, the exposed cords, in storage, tend to become entangled with other stored articles, and moving articles in and out of storage adjacent to an appliance with wraparound cord storage, tends to disturb the loops of cord on the stored appliance.

It is an object of the present invention to provide an electrical hair dryer which is relatively compact, and particularly adapted for convenient storage in a minimum of storage space.

It is an important object of the present invention to provide a hair dryer having an overall configuration which provides convenient and safe out-of-the-way completely enclosed storage of the unit's electrical cord.

It is another object of the present invention to provide a hair dryer having a configuration in which the electrical cord is safetly and conveniently stored, and which storage facility does not require the use of bulk, expensive moving parts, and particularly does not require the use of high tensioned biasing components and mechanisms which have a tendency to take up a lot of space and to become worn and expensive to repair.

These and other objects which will be apparent hereinafter are achieved in accordance with the present invention which is described herein and with the aid of the accompanying drawings in which.

Figures 1, 2, 3, 4:
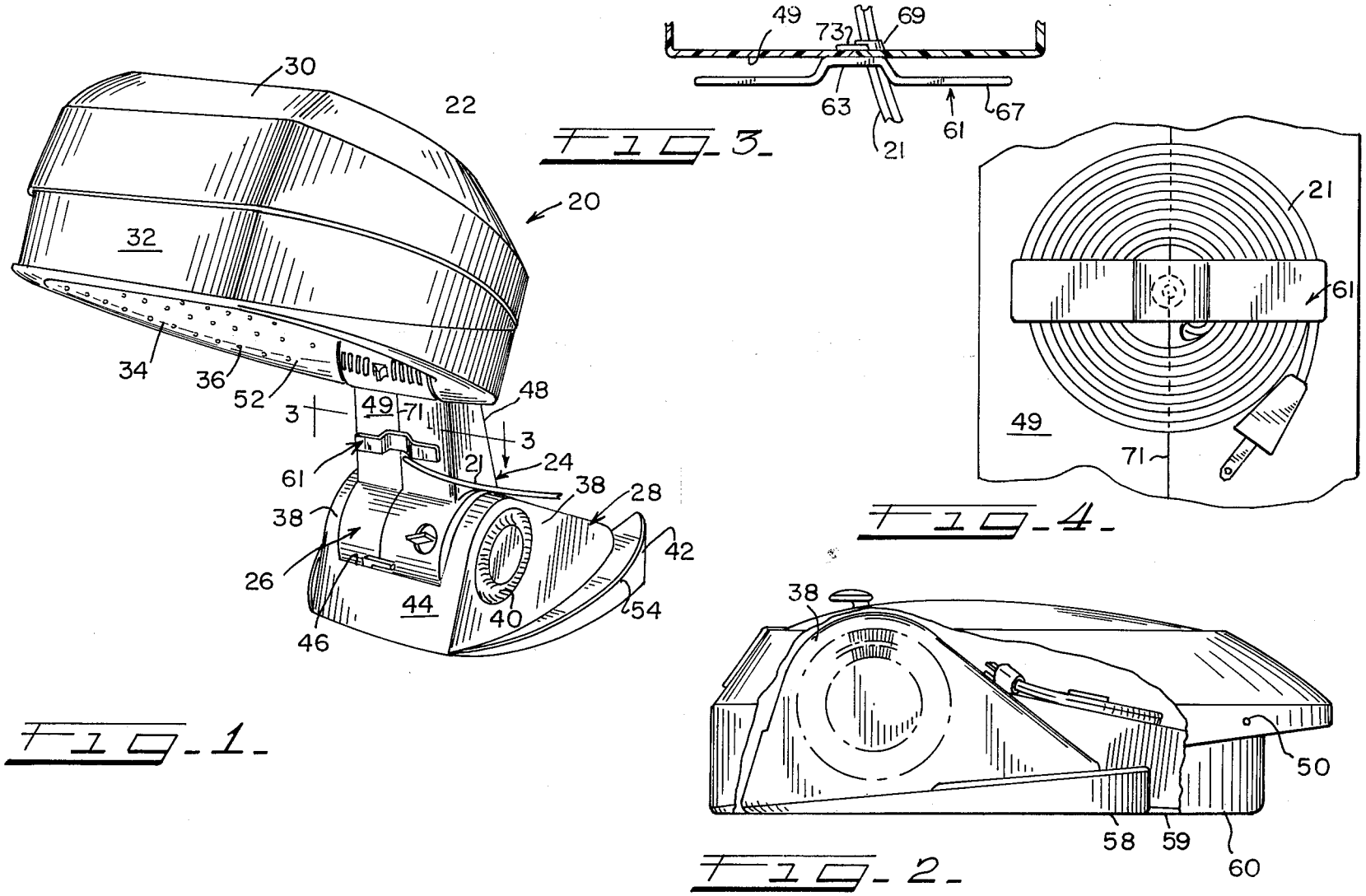
FIG. 1 is a perspective view of the improved hair dryer in accordance with the present invention.
FIG. 2 is a side view of the hair dryer shown in FIG. 1 in which a portion of the dryer is shown cut-away.
FIG. 3 is an enlarged cross-sectional view taken approximately along the line 3—3 of FIG. 1.
FIG. 4 is a front elevational view of the central portion of the hair dryer when the hair dryer is in open or operating configuration.

Referring now to the drawings in greater detail, FIG. 1 shows the invention to be embodied in a dryer assembly generally designated 20 having a head assembly 22 pivotally mounted atop a head mounting assembly 24, the lower portion of which forms an impeller housing 26 which is pivotally received within a base unit 28. The pivots at the ends of head mounting assembly 24 have substantially parallel and substantially horizontal axes. Head assembly 22 includes an upper cover or shell portion 30 and the exterior wall portion 32 of a somewhat elongated generally annular drying air distribution plenum 34 having a plurality of radially inwardly directed openings 36 therein.

The base assembly 28 includes a pair of legs 38, 38, each having a louvered annular inlet opening 40 for fresh air, and each having a tray assembly 42 associated therewith for receiving pins, curlers or the like. The front wall 44 of the base assembly 28 includes an edge portion 46 of reduced height, permitting the neck portion 48 of the head mounting unit 24 to be placed in various positions with respect thereto.

In operation air is drawn through openings 40, by impellers (not shown) in impeller housing 26, and forced through hollow portion of head mounting assembly 24 into plenum 34.

As shown in FIG. 2, the dryer unit 20 may be collapsed for storage by pivoting the cover or shell 30 about a pivot point 50, and by pivoting head support element 24 around the central axis of annular openings 40, to lower the cover 30 to a position wherein the lower edge 52 closely overlies an inclined upper locating edge 54 formed in the wall of 42. It will be appreciated from a consideration of FIG. 2, when dryer 10 is in storage configuration, that the bottom surface 58 of base unit 28 lies approximately flush with and closely adjacent to the bottom surface 60 of the lower shell 32, and back face 59 of neck portion 48 closing off the interior of the head assembly 22 from the bottom. By reason of the design of the principal elements of dryer 20, the profile represented by the unit 20 in the retracted or collapsed condition thereof is much lower than the profile able to be achieved with dryers of other designs.

Thus, the dryer of the present invention can be regarded as having the configuration of an articulated "Z," that is, a hinged, collapsible "Z" in which base element 28 and hood element 22 can be considered to be the generally horizontally disposed end portions of the hinged "Z," and wherein head support element 24 can be considered to be the middle portion of the hinged "Z." Moreover, the head support element 24, and the base portion 28 are, as a consequence of the structural relationships described hereinbefore, completely retractable or nestable within head assembly 22.

Details of the hinging and locking mechanisms which can be used in the hinged "Z" configuration hard hat type dryers do not constitute a part of the novel aspects of the present invention, and details of an eminently satisfactory construction for hinging and locking the position of the elements 22, 24, 28 in operating configurations or a storage configuration are found in copending application Ser. No. 229,763 filed Feb. 28, 1972 for Hair Dryer, said application being owned by common assignee of the present invention.

In the described form of the present invention, the electrical cord for supplying power to the impeller portion 26 at the bottom of head support element 24 passes through front wall 49, and can be immobilized on cord support means generally indicated by the number 61.

In the illustrated embodiment, cord support means 61 comprises a cleat with a central base portion 63 and laterally disposed winged portions 67. Base portion 63 includes clip portion 69 which extends through an opening along the joint line 71 between the adjacent respective halves of front wall 49, and is secured therein by a retainer element, e.g. "C" washer 73.

In the preferred form of the present invention illustrated in the drawings, cord support means 61 is carried by the front wall 49, adjacent the point at which cord 21 enters neck portion 48. In preparation for storage, therefore, cord 21 is conveniently wound around cord storage cleat 61 and immobilized, as shown in FIG. 4, upon collapsing of dryer 20 to the storage configuration shown in FIG. 2, the cord is completely within the head space of head assembly 22. In this configuration, it is readily apparent that the cord is completely out of the way, and interferes with none of the hinges, or any other surfaces which move in close proximity to each other upon nesting of base element 28 within hood 22. Nonetheless, immediately upon opening of the dryer 20 to the operating configuration shown in FIG. 1, the cord is immediately accessible to the user. Should the cord 21 be wound loosely, or with loops and curls, these extending portions of the cord will not constitute a hazard in storage, because of the fact that they are completely enclosed within the head assembly 22.

Having received this disclosure of the invention, and a particularly preferred embodiment thereof, it will be apparent to those skilled in the art that many modifications and variations thereof can be made without departing from the spirit or scope of the invention. Specific disclosures and drawings are provided herein to illustrate a particularly preferred embodiment, and are not to be construed as limiting the scope of the invention, which is defined in the claims appended hereto.

We claim:

1. In a portable hair dryer of the type having a base; a head assembly including a dome-shaped head receiving recess for receiving a portion of the head of a user; and a head assembly support including a housing pivotably attached at one end to said base and at its other end to said head assembly for supporting said head assembly in an operating configuration above said base, or in a collapsed storage configuration wherein said head support lies within said head receiving recess, the front surface of said support facing the dome-shaped surface of said recess to define a free space of limited dimensions therebetween, a blower and a heating element being contained within said head support housing for supplying a heated air stream to said head assembly; and a power cord extending through said housing for supplying operating power to said blower and said heating element; storage means for said power cord comprising, in combination:

an elongated retaining member having a center base portion contoured to lie flat against said front surface of said head support, and further having winged end portions whereby the ends of said retaining member are spaced apart from said front surface to form in cooperation therewith a reel assembly for receiving said power cord; and means for mounting said center base portion of said retaining member to said front surface of said head support whereby said power cord is contained within said free space between said front surface of said head support and said dome-shaped surface of said recess when said head assembly is in said storage configuration.

2. A power cord storage assembly as defined in claim 1 wherein said winged portions extend from said center base portion initially away from and then parallel to said front surface of said head support with a spacing from said front surface substantially equal to the diameter of said power cord.

3. A power cord storage assembly as defined in claim 2 wherein said bracket member comprises a metallic strip disposed parallel to said front surface of said head support.

4. A power cord storage assembly as defined in claim 3 wherein said mounting means comprise a kick-up on said base portion of said strip and an aperture in said front surface of said head support for receiving said kick-up.

* * * * *